US011412795B2

(12) United States Patent
Jones

(10) Patent No.: US 11,412,795 B2
(45) Date of Patent: Aug. 16, 2022

(54) PERSPIRATION ABSORBING DEVICE

(71) Applicant: Dorothea Jones, Cincinnati, OH (US)

(72) Inventor: Dorothea Jones, Cincinnati, OH (US)

( * ) Notice: Subject to any disclaimer, the term of this patent is extended or adjusted under 35 U.S.C. 154(b) by 511 days.

(21) Appl. No.: 16/575,517

(22) Filed: Sep. 19, 2019

(65) Prior Publication Data

US 2021/0085005 A1 Mar. 25, 2021

(51) Int. Cl.
*A41D 27/13* (2006.01)

(52) U.S. Cl.
CPC ..... *A41D 27/133* (2013.01)

(58) Field of Classification Search
CPC ..... A41D 27/133
USPC ..... 2/55
See application file for complete search history.

(56) References Cited

U.S. PATENT DOCUMENTS 375,239 A 12/1887 Wheeler
2,719,976 A * 10/1955 Sussman ..... A41C 1/003 450/103
3,885,247 A 5/1975 Kost
5,037,412 A * 8/1991 Tanzer ..... A61L 15/46 604/359
5,342,333 A * 8/1994 Tanzer ..... A61K 8/0208 604/359
5,790,982 A * 8/1998 Boutboul ..... A41D 27/133 2/53
D627,542 S 11/2010 Nichols
2002/0032420 A1* 3/2002 Taylor ..... A41D 27/13 604/385.03
2010/0189753 A1* 7/2010 Van Bavel ..... A41D 27/133 424/68
2010/0299796 A1* 12/2010 Hashemian ..... A41D 27/133 2/53
2011/0252534 A1* 10/2011 Taylor ..... A41D 27/13 2/46
2015/0245679 A1 9/2015 Leete
2016/0242478 A1 8/2016 Howard

FOREIGN PATENT DOCUMENTS

WO WO2013136032 9/2013

* cited by examiner

*Primary Examiner* — Gloria M Hale

(57) ABSTRACT

A perspiration absorbing device for preventing staining due to perspiration and for masking body odor includes a second panel that is coupled by opposing termini and a first side to a first panel to define a pocket. A pair of couplers is coupled singly proximate to opposing edges of the first panel. The couplers are configured to couple the first panel to at least one of skin of a user and an interior surface of a garment so that the first panel is positioned proximate to a respective armpit of the user. The first panel and the second panel are configured to absorb perspiration. Each of a set of sachets is selectively insertable into the pocket so that the sachet is configured to emit a fragrance to mask body odor.

15 Claims, 6 Drawing Sheets

PERSPIRATION ABSORBING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to absorbing devices and more particularly pertains to a new absorbing device for preventing staining due to perspiration and for masking body odor.

(2) Description of Related Art Including Information Disclosed Under 37 CFR 1.97 and 1.98

The prior art relates to absorbing devices.

BRIEF SUMMARY OF THE INVENTION

An embodiment of the disclosure meets the needs presented above by generally comprising a second panel that is coupled by opposing termini and a first side to a first panel to define a pocket. A pair of couplers is coupled singly proximate to opposing edges of the first panel. The couplers are configured to couple the first panel to at least one of skin of a user and an interior surface of a garment so that the first panel is positioned proximate to a respective armpit of the user. The first panel and the second panel are configured to absorb perspiration. Each of a set of sachets is selectively insertable into the pocket so that the sachet is configured to emit a fragrance to mask body odor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
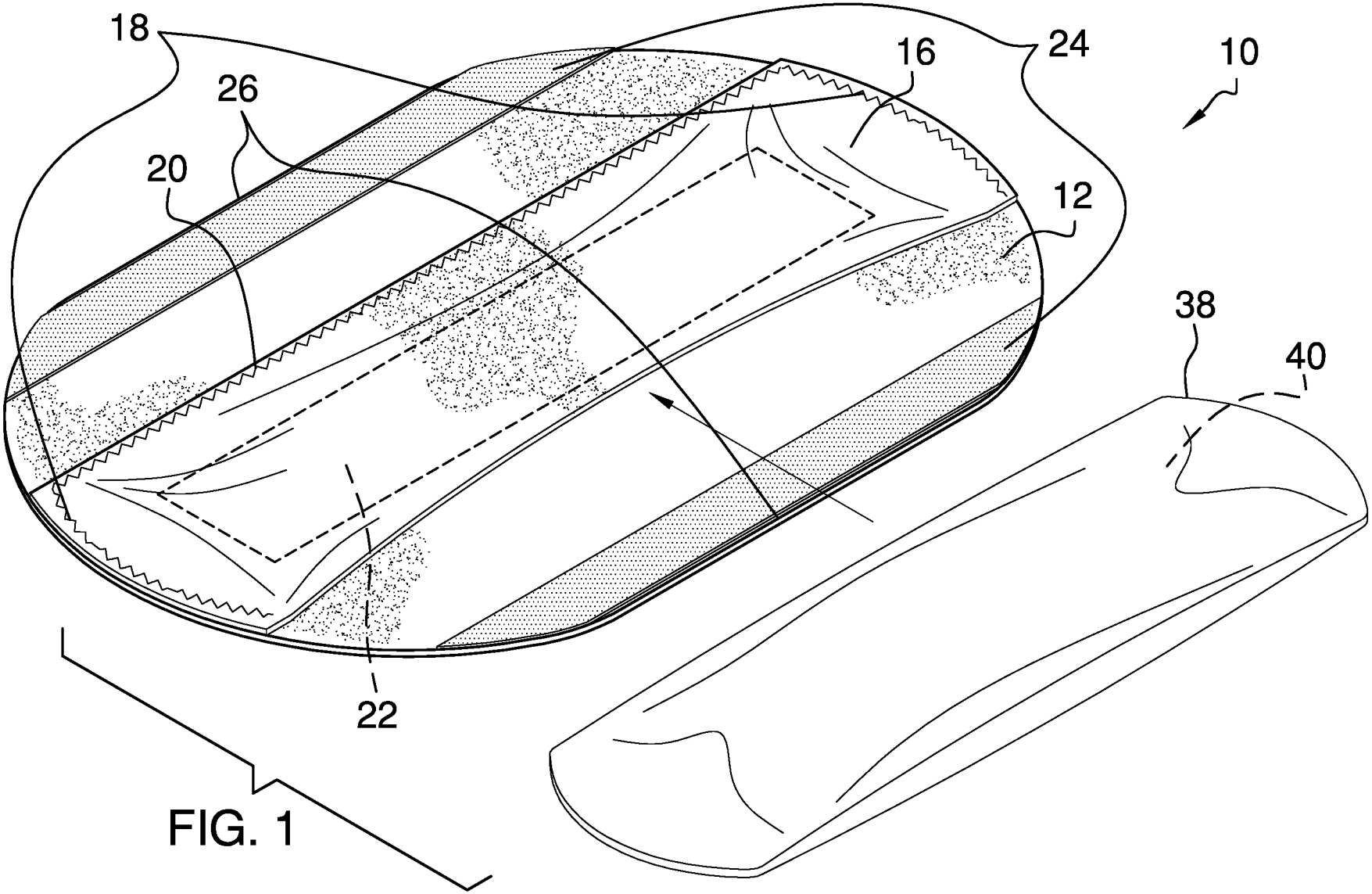
FIG. 1 is an isometric perspective view of a perspiration absorbing device according to an embodiment of the disclosure.

With reference now to the drawings, and in particular to FIGS. 1 through 6 thereof, a new absorbing device embodying the principles and concepts of an embodiment of the disclosure and generally designated by the reference numeral 10 will be described.

As best illustrated in FIGS. 1 through 6, the perspiration absorbing device 10 generally comprises a first panel 12, which has opposing ends 14 that are arcuate. As will become apparent, the opposing ends 14 being arcuate allows the first panel 12 to conform to the curvature of an armpit of a user.

A second panel 16 is coupled by opposing termini 18 and a first side 20 to the first panel 12 to define a pocket 22. The second panel 16 may be stitchedly coupled to the first panel 12 or may be coupled to the first panel 12 by other coupling means, such as, but not limited to, adhesives, hook and loop fasteners, and the like. The second panel 16 and the first panel 12 comprise fabric. The second panel 16 and the first panel 12 may comprise cotton, or other absorbent material, such as, but not limited to, hemp, bamboo, polyester, beach tree cellulose, and the like.

A pair of couplers 24 is coupled singly proximate to opposing edges 26 of the first panel 12. The couplers 24 are configured to couple the first panel 12 to at least one of skin of the user and an interior surface of a garment so that the first panel 12 is positioned proximate to a respective armpit of the user. The first panel 12 and the second panel 16 are configured to absorb perspiration.

Figure 6:
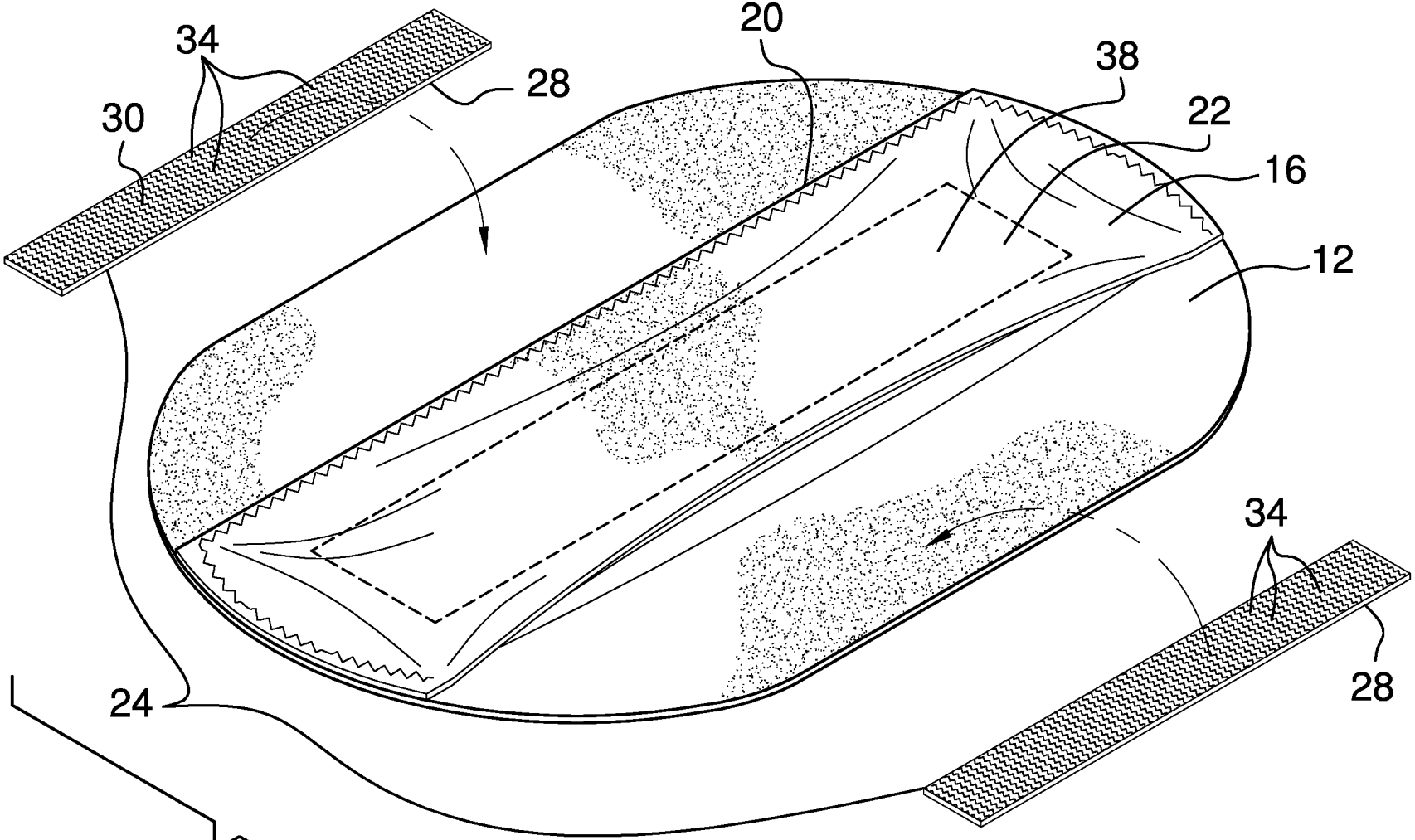
FIG. 6 is an exploded view of an alternative embodiment of the disclosure.

Each first coupler 24 comprises a first strip 28 and a fastener 30. The fastener 30 is coupled to the first strip 28. The fastener 30 comprises at least one of an adhesive film 32, as shown in FIGS. 1-4, and a plurality of hooking elements 34, as shown in FIG. 6. The adhesive film 32 is configured to selectively adhesively couple to the skin of the user and to the interior surface of the garment. A user with sensitive skin may elect to use the adhesive films 32 to couple the first panel 12 to the interior surface of the garment rather than directly to the skin proximate to the armpit. The plurality of hooking elements 34 is configured to couple to the interior surface of the garment, providing another option for coupling the first panel 12 to the garment. The first strip 28 may be adhesively coupled to the first panel 12 or may be coupled to the first panel 12 by other means, such as stitching and the like. The first strip 28 extends substantially between the opposing ends 14 of the first panel 12.

Figure 2:
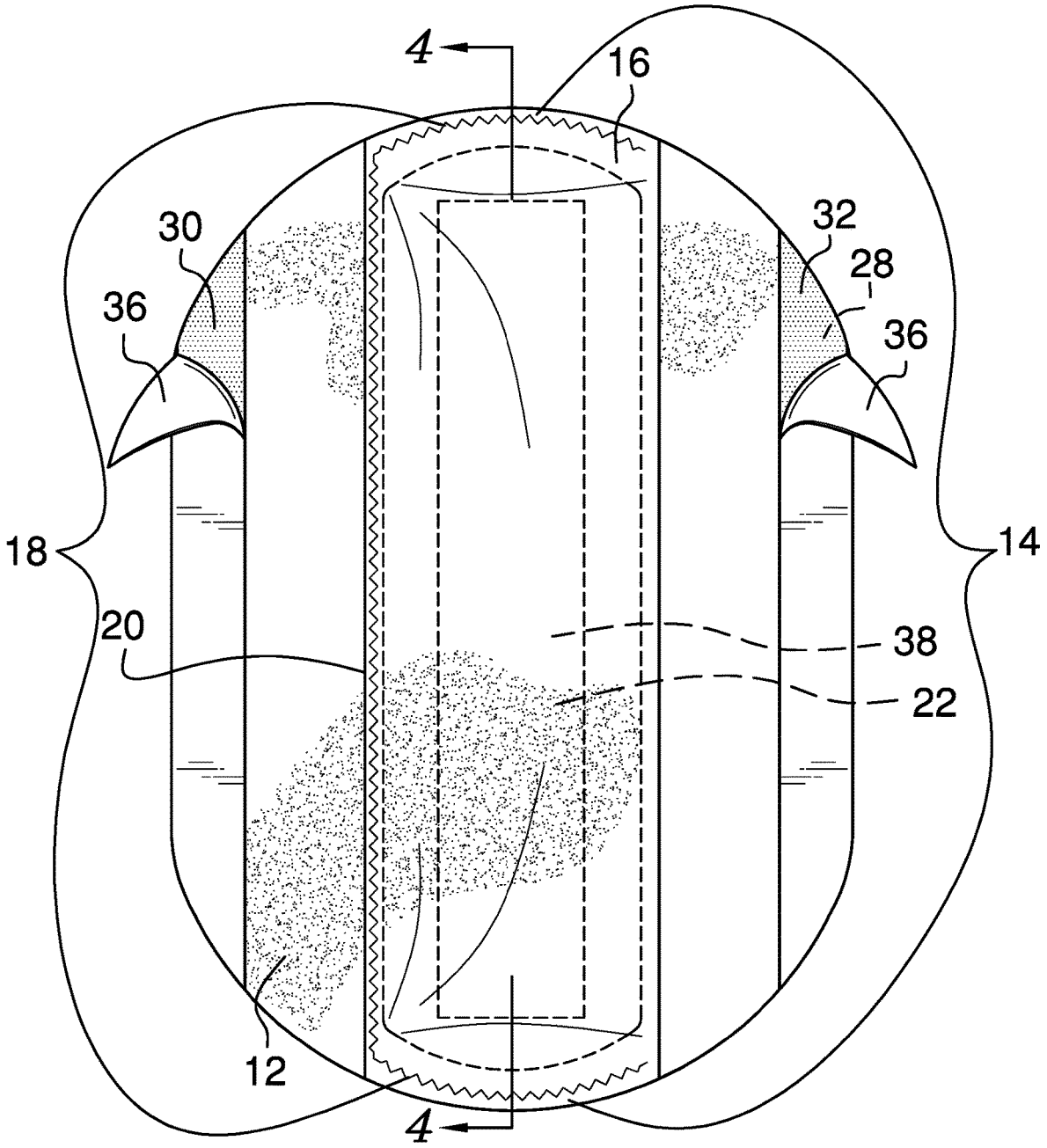
FIG. 2 is a front view of an embodiment of the disclosure.
Figure 3:
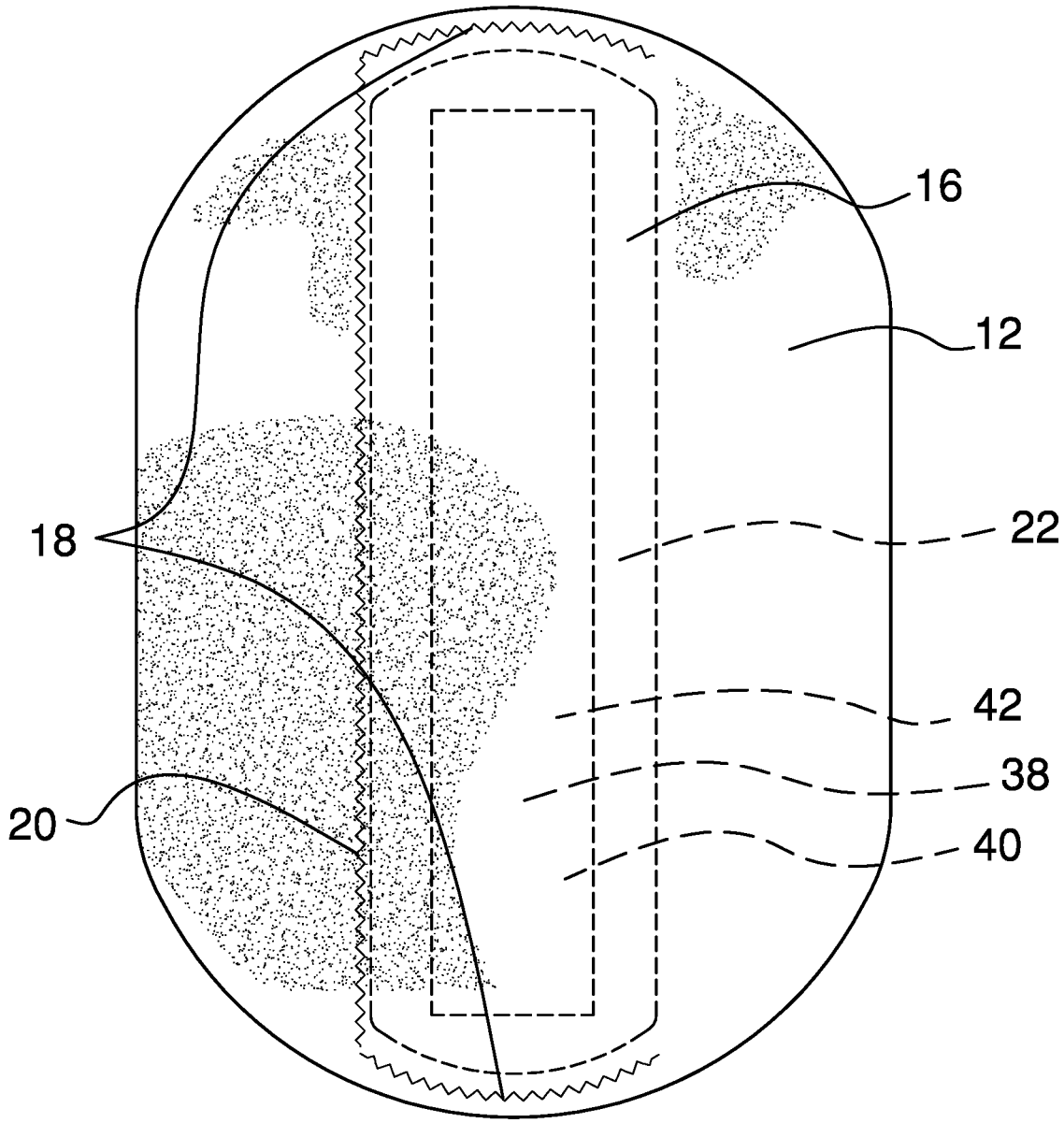
FIG. 3 is a back view of an embodiment of the disclosure.
Figure 4:
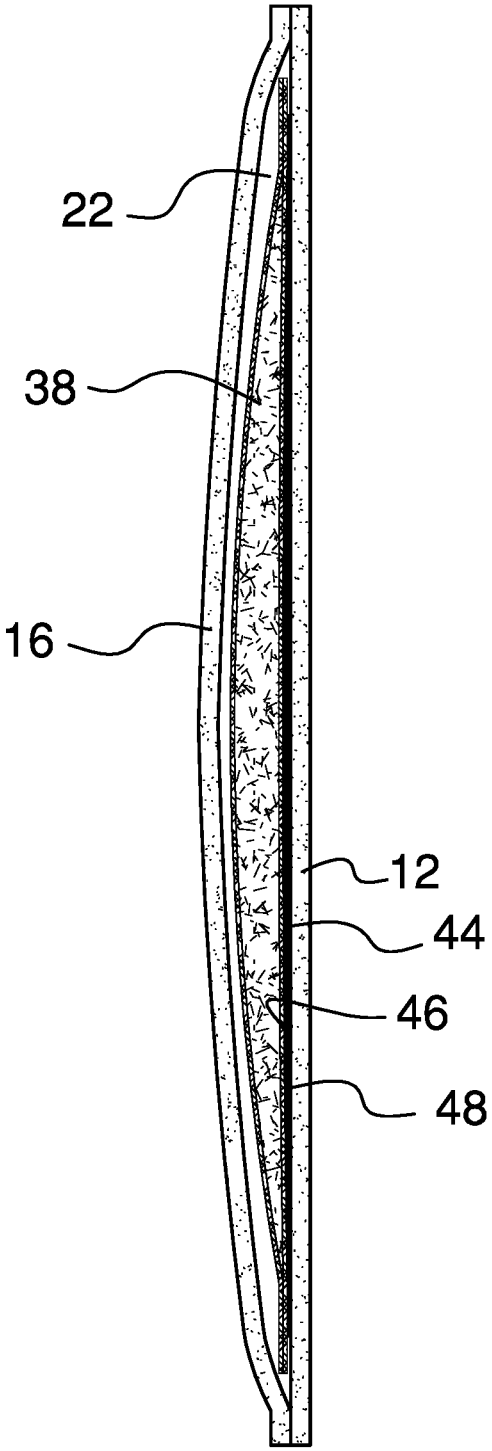
FIG. 4 is a cross-sectional view of an embodiment of the disclosure.
Figure 5:
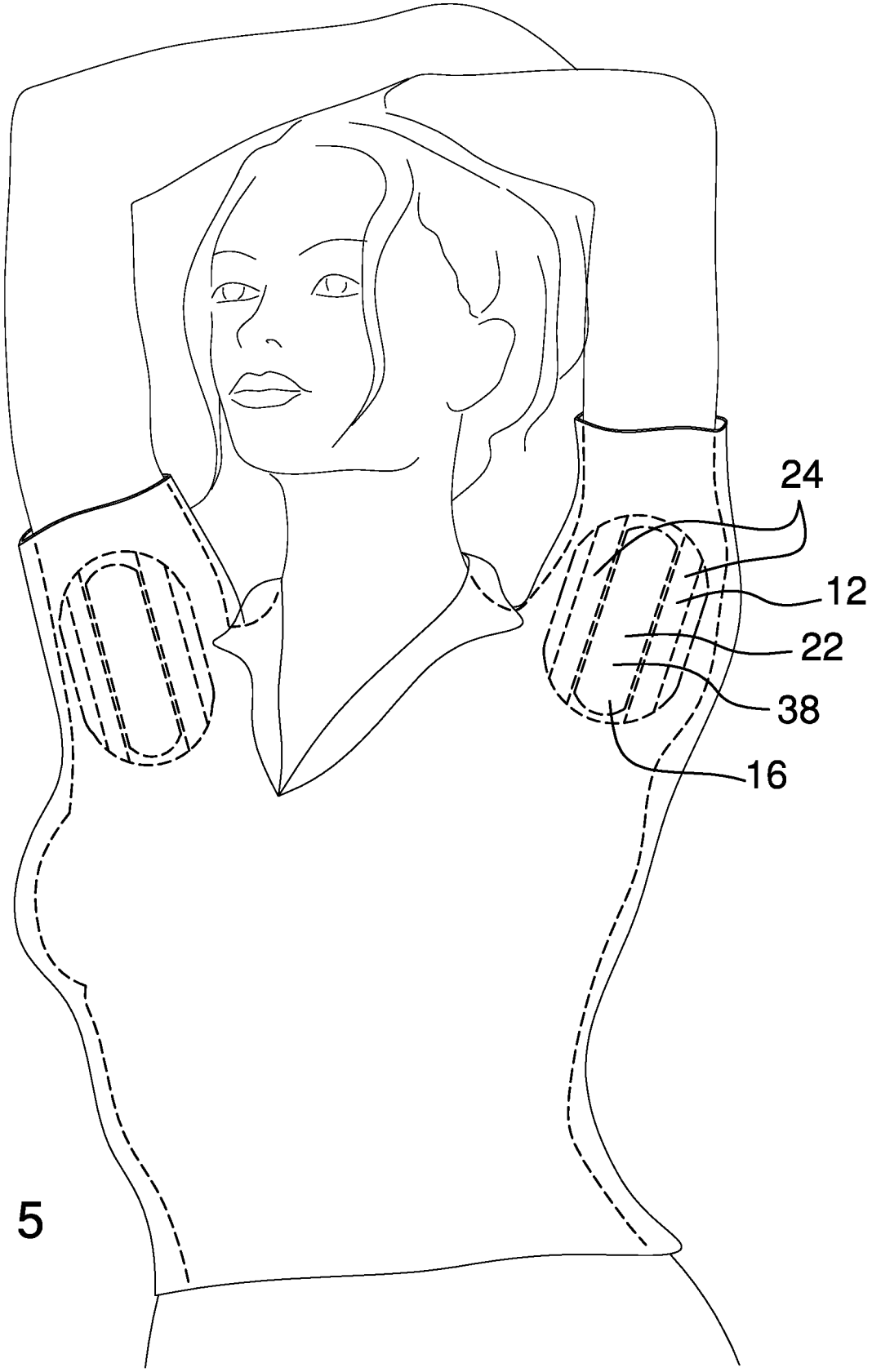
FIG. 5 is an in-use view of an embodiment of the disclosure.

A second strip 36 is removably coupled to the adhesive film 32, as shown in FIG. 2. The second strip 36 is configured to prevent inadvertent adhesion of the adhesive film 32 and to be selectively removed from the adhesive film 32, positioning the adhesive film 32 to selectively adhesively couple to the skin of the user and to the interior surface of the garment.

Each of a set of sachets 38 is selectively insertable into the pocket 22. The sachet 38 is configured to emit a fragrance to mask body odor. Each sachet 38 emits a respective fragrance so that the set of sachets 38 comprises sachets 38 that emit a variety of fragrances. The sachet 38 may comprise an essential oil 40, or other aroma compound, such as, but not limited to, esters, terpenes, aromatics, and the like. The sachet 38 may comprise at least one of sodium bicarbonate and corn starch, or other adsorbent or hygroscopic material, such as, but not limited to, sodium polyacrylate, silica gel, sodium chloride, sucrose, and the like.

The device 10 also comprises a set of connectors 42. Each connector 42 is coupled to a respective sachet 38 so that the connector 42 is positioned to selectively couple to at least one of the first panel 12 and the second panel 16 to secure the respective sachet 38 within the pocket 22. Each connector 42 comprises a tape 44, which is double sided type so that a first surface 46 of the tape 44 is positioned to couple to the respective sachet 38 and a second surface 48 of the tape 44 is positioned to couple to at least one of the first panel 12 and the second panel 16.

In use, a respective sachet 38 is positioned in the pocket 22 and is secured in place by the tape 44. The second strips 36 are removed from the adhesive films 32, positioning the adhesive films 32 to be adhesively coupled to the skin of the user or to the interior surface of the garment, depending on a preference of the user. The first panel 12 and the second panel 16 absorb the perspiration of the user and the sachet 38 emits the fragrance to mask the body odor.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A perspiration absorbing device comprising:

a first panel;

a second panel coupled by opposing termini and a first side of the first panel defining a pocket;

a pair of couplers coupled singly proximate to opposing edges of the first panel wherein the couplers are configured for coupling the first panel to at least one of skin of a user and an interior surface of a garment such that the first panel is positioned proximate to a respective armpit of the user wherein the first panel and the second panel are configured for absorbing perspiration; and a set of sachets, each sachet being selectively insertable into the pocket wherein the sachet is configured for emitting a fragrance for masking body odor.

2. The device of claim 1, further including the first panel having opposing ends, the opposing ends being arcuate.

3. The device of claim 1, further including the second panel being stitchedly coupled to the first panel.

4. The device of claim 1, further including the second panel and the first panel comprising fabric.

5. The device of claim 4, further including the second panel and the first panel comprising cotton.

6. The device of claim 1, further including each first coupler comprising a first strip and a fastener, the fastener being coupled to the first strip, the fastener comprising at least one of an adhesive film and a plurality of hooking elements wherein the adhesive film is configured for selectively adhesively coupling to the skin of the user and to the interior surface of the garment and wherein the plurality of hooking elements is configured for coupling to the interior surface of the garment.

7. The device of claim 6, further including the first strip being adhesively coupled to the first panel.

8. The device of claim 6, further including the first strip extending substantially between opposing ends of the first panel.

9. The device of claim 6, further including a second strip removably coupled to the adhesive film wherein the second strip is configured for preventing inadvertent adhesion of the adhesive film and wherein the second strip is configured for removing from the adhesive film positioning the adhesive film for selectively adhesively coupling to the skin of the user and to the interior surface of the garment.

10. The device of claim 1, further including each sachet emitting a respective fragrance such that the set of sachets comprises sachets emitting a variety of fragrances.

11. The device of claim 10, further including the sachet comprising an essential oil.

12. The device of claim 1, further including the sachet comprising at least one of sodium bicarbonate and corn starch.

13. The device of claim 1, further including a set of connectors, each connector being coupled to a respective sachet such that the connector is positioned for selectively coupling to at least one of the first panel and the second panel for securing the respective sachet within the pocket.

14. The device of claim 13, further including each connector comprising a tape, the tape being double sided type such that a first surface of the tape is positioned for coupling to the respective sachet and a second surface of the tape is positioned for coupling to at least one of the first panel and the second panel.

15. A perspiration absorbing device comprising:

a first panel, the first panel having opposing ends, the opposing ends being arcuate;

a second panel coupled by opposing termini and a first side of the first panel defining a pocket, the second panel being stitchedly coupled to the first panel, the second panel and the first panel comprising fabric, the second panel and the first panel comprising cotton;

a pair of couplers coupled singly proximate to opposing edges of the first panel wherein the couplers are configured for coupling the first panel to at least one of skin of a user and an interior surface of a garment such that the first panel is positioned proximate to a respective armpit of the user wherein the first panel and the second panel are configured for absorbing perspiration, each first coupler comprising a first strip and a fastener, the fastener being coupled to the first strip, the fastener comprising at least one of an adhesive film and a plurality of hooking elements wherein the adhesive film is configured for selectively adhesively coupling to the skin of the user and to the interior surface of the garment and wherein the plurality of hooking elements is configured for coupling to the interior surface of the garment, the first strip being adhesively coupled to the first panel, the first strip extending substantially between the opposing ends of the first panel;

a second strip removably coupled to the adhesive film wherein the second strip is configured for preventing inadvertent adhesion of the adhesive film and wherein the second strip is configured for removing from the adhesive film positioning the adhesive film for selectively adhesively coupling to the skin of the user and to the interior surface of the garment;

a set of sachets, each sachet being selectively insertable into the pocket wherein the sachet is configured for emitting a fragrance for masking body odor, each sachet emitting a respective fragrance such that the set of sachets comprises sachets emitting a variety of fragrances, the sachet comprising an essential oil, the sachet comprising at least one of sodium bicarbonate and corn starch; and a set of connectors, each connector being coupled to a respective sachet such that the connector is positioned for selectively coupling to at least one of the first panel and the second panel for securing the respective sachet within the pocket, each connector comprising a tape, the tape being double sided type such that a first surface of the tape is positioned for coupling to the respective sachet and a second surface of the tape is positioned for coupling to at least one of the first panel and the second panel.

* * * * *